US006152058A

United States Patent [19]

Tajima et al.

[11] Patent Number: 6,152,058

[45] Date of Patent: Nov. 28, 2000

[54] THREAD CUTTING DEVICE IN SEWING MACHINE

[75] Inventors: Ikuo Tajima; Satoru Suzuki; Tomoki Hashimoto, all of Kasugai, Japan

[73] Assignee: Tokai Kogyo Mishin Kabushiki Kaisha, Kasugai, Japan

[21] Appl. No.: 09/318,607

[22] Filed: May 26, 1999

[30] Foreign Application Priority Data

May 28, 1998 [JP] Japan ..... 10-147601

[51] Int. Cl.[7] ..... D05B 65/00

[52] U.S. Cl. ..... 112/292

[58] Field of Search ..... 112/285, 291, 112/292, 295, 298

[56] References Cited

U.S. PATENT DOCUMENTS 4,589,362 5/1986 Dusch ..... 112/292
4,630,559 12/1986 Kinoshita ..... 112/291
5,131,340 7/1992 Tajima et al. ..... 112/292
5,755,170 5/1998 Tajima et al. ..... 112/292
5,964,170 10/1999 Gries ..... 112/291

FOREIGN PATENT DOCUMENTS 2-67980 5/1990 Japan .

*Primary Examiner*—Ismael Izaguirre
*Attorney, Agent, or Firm*—Dennison, Scheiner, Schultz & Wakeman

[57] ABSTRACT

A thread cutting device is provided in a sewing machine that is operable to form stitches on a fabric using an upper thread and a lower thread. The thread cutting device may include a fixed knife and a movable knife cooperating with each other to cut either one or both of the upper and lower threads. The movable knife may be operable to cut the upper thread at a first timing and to cut the lower thread at a second timing that is different from the first timing.

11 Claims, 7 Drawing Sheets

THREAD CUTTING DEVICE IN SEWING MACHINE

BACKGROUND OF THE INVENTION

1. Field of the Invention

The present invention relates to a thread cutting device in a sewing machine, and in particular to a thread cutting device that is selectively operable to cut both upper and lower threads or to only cut an upper thread.

2. Description of the Related Art

Japanese Laid-Open Utility Model Publication No. 2-67980 teaches a thread cutting device in a sewing machine that comprises a movable knife and a fixed knife, which cooperate with each other in order to cut a thread or threads. In order to selectively cut both upper and lower threads or only an upper thread, a lower thread evacuating lever and an actuation mechanism associated therewith are provided. When only the upper thread is to be cut, the evacuating lever is actuated at a predetermined timing during the movement or the movable knife or during the rotation of a hook so as to engage and move the lower thread out of the moving path of the movable knife.

However, due to the incorporation of the evacuating lever and its associated actuation mechanism, operation timing adjustments of the evacuating lever, as well as maintenance work on the evacuating lever and its associated actuation mechanism, are required. In addition, this design may increase the number of parts that are necessary to cut the threads.

SUMMARY OF THE INVENTION

It is, accordingly, an object of the invention to provide an improved thread cutting device.

Preferably, a thread cutting device is provided in a sewing machine that is operable to form stitches on a fabric using an upper thread and a lower thread. The thread cutting device may include a fixed knife and a movable knife cooperating with each other to cut either one or both of the upper and lower threads. The movable knife may be operable to cut the upper thread at a first timing and to cut the lower thread at a second timing that is different from the first timing.

The movable knife may include a cutting edge, an upper thread engaging portion and a lower thread engaging portion. The upper thread engaging portion and the lower thread engaging portion may be disposed at different positions from each other.

Preferably, the movable knife is operable to move within a first movable range and a second movable range for engaging and cutting the upper thread and the lower thread, respectively. The first movable range and the second movable range may be different from each other.

Other objects, features and advantages of the present invention will be readily understood after reading the following detailed description together with the accompanying drawings and the claims.

DETAILED DESCRIPTION OF THE INVENTION

Figure 1:
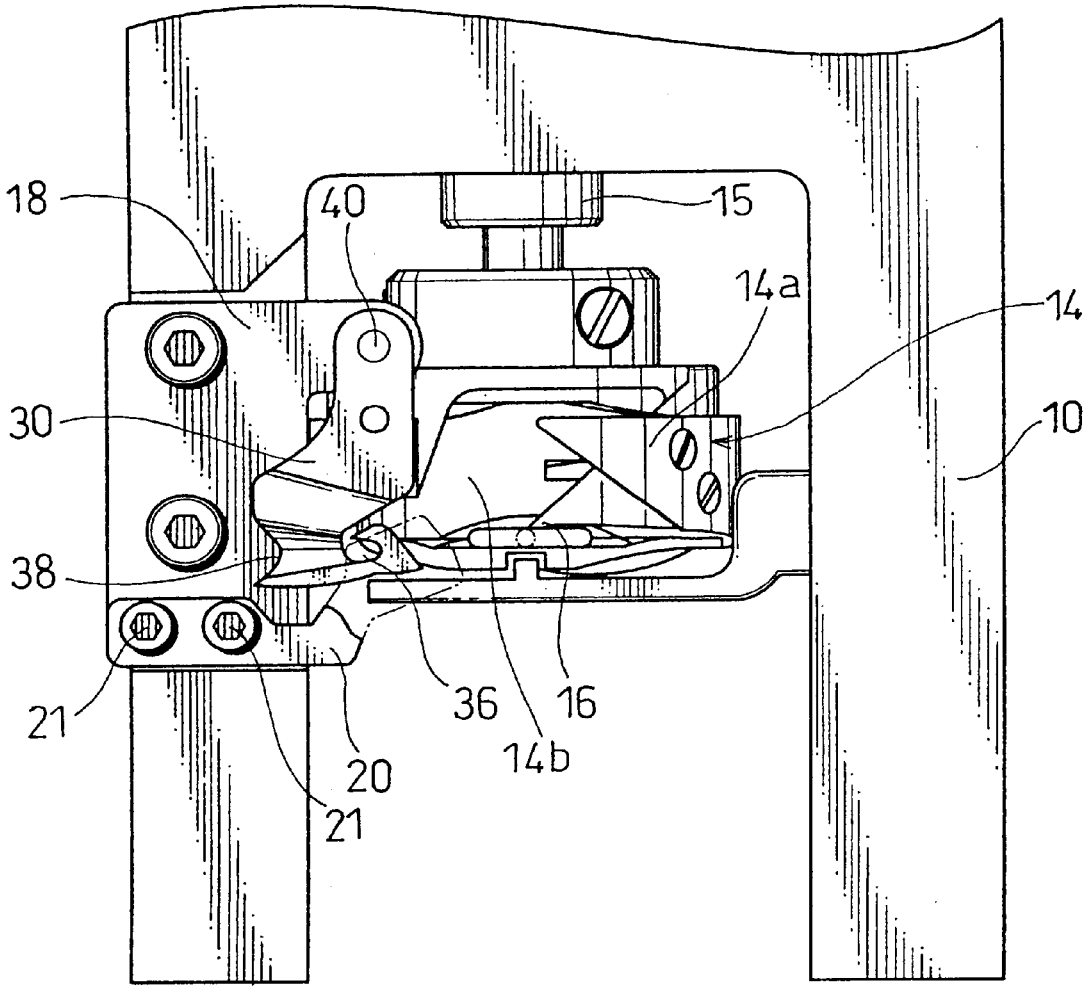
FIG. 1 is a plan view of a representative embodiment of a thread cutting device according to the present teachings.

Preferably, a thread cutting device is provided in a sewing machine that is operable to form stitches on a fabric using an upper thread and a lower thread. The thread cutting device may include a fixed knife and a movable knife cooperating with each other to cut either one or both of the upper and lower threads. The movable knife may be operable to cut the upper thread at a first timing and to cut the lower thread at a second timing that is different from the first timing.

Because, the upper thread and the lower thread may be cut at different timings from each other, a lower thread evacuation lever for evacuating the lower thread is not required when only the upper thread is to be cut. In addition, an actuation mechanism for actuating such a lower thread evacuation lever is not required. Therefore, timing adjustment operations for the evacuation lever and maintenance work for the evacuation lever and its associated actuation mechanism are not required. In addition, the number of parts of the thread cutting device can be reduced.

Preferably, the second timing is chosen to be subsequent to the first timing. Therefore, the selection of cutting both the upper and lower threads or cutting only the upper thread can be reliably performed. Generally, the operation of cutting only the upper thread is more frequently performed in comparison to the cutting operation of both the upper and lower threads. As a result, the reliability can be improved.

Preferably, the movable knife has a cutting edge, an upper thread engaging portion and a lower thread engaging portion. The upper thread engaging portion and the lower thread engaging portion may be disposed at different positions from each other.

The movable knife may be operable to move within a first movable range and a second movable range for engaging and cutting the upper thread and the lower thread, respectively. The first movable range and the second movable range may be different from each other.

Preferably, the first movable range extends between a waiting position and a first operative position, while the second movable range extends between the waiting position and a second operative position.

The movable knife in the first operative position may permit the upper thread to be engaged with the upper thread engaging portion while a hook of the sewing machine rotates with the upper thread engaged by the hook.

Thus, the movement of the upper thread to engage the upper thread engaging portion may be driven by the rotation of the hook. Therefore, the cutting operation can be reliably performed without suffering the influence of the tension that is applied to the upper thread. More importantly, the portion of the upper thread closest to the sewing needle, which portion is to be cut, may be reliably separated from the portion of the upper thread closest to the fabric. Therefore, the cutting operation of the upper thread can be reliably performed without accidentally cutting both the sewing needle side portion and the fabric side portion of the upper thread.

Each of the additional features and method steps disclosed above and below may be utilized separately or in conjunction with other features and method steps to provide improved thread cutting devices and methods for designing and using such thread cutting devices. Representative examples of the present invention, which examples utilize many of these additional features and method steps in conjunction, will now be described in detail with reference to the drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detail description may not be necessary to practice the invention in the broadest sense, and are instead taught merely to particularly describe representative examples of the invention.

A detailed description will now be given of a representative example with reference to the accompanying drawings.

FIG. 1 is a plan view of the representative embodiment showing a thread cutting device and various mechanisms of a sewing machine associated with the thread cutting device. A front view of FIG. 1 is shown in FIG. 2.

Figure 2:
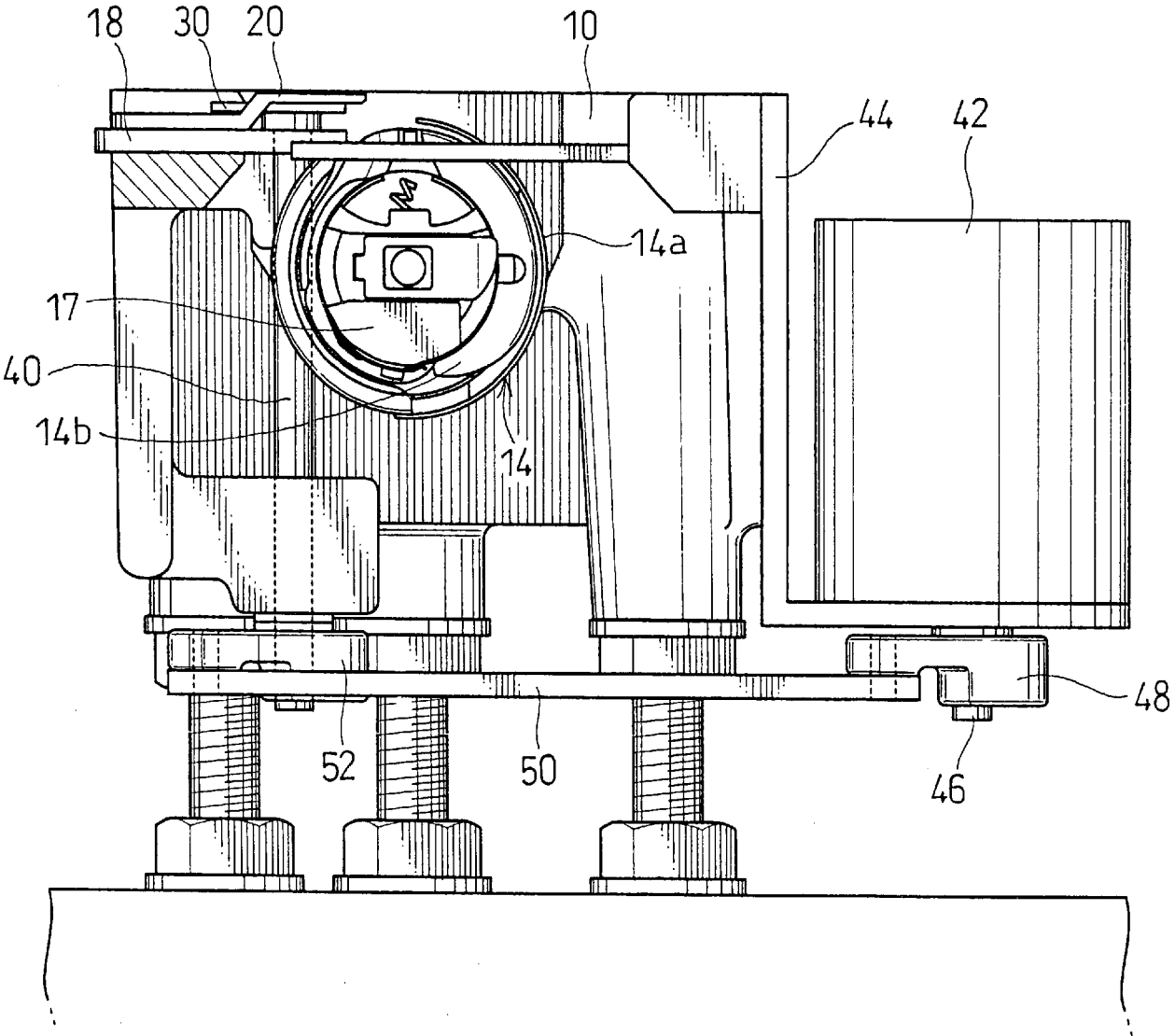
FIG. 2 is a front view of FIG. 1.

As will be seen from FIGS. 1 and 2, the sewing machine includes a hook base 10 and a hook 14. The hook 14 comprises a rotating hook 14*a* and a hook holder 14*b*. The rotating hook 14*a* has a hook end 16 and is rotatably received within the hook base 10. The rotating hook 14*a* may be connected to a hook drive shaft 15 that is connected to a main shaft (not shown) of the sewing machine, so that the rotating hook 14*a* is rotatably driven relative to the hook holder 14*b*. A bobbin case 17 is inserted into the hook holder 14*b* and has a bobbin (not shown) mounted inside. A lower thread T2 is wound about the bobbin and will be explained in further detail below. A reciprocating sewing needle (not shown) may move into and out of the hook 14 through a needle hole 12 (see FIG. 3). The needle hole 12 is formed in a throat plate (not shown) that is mounted on the hook base 10 in a position above the hook 14. The sewing needle cooperates with the hook to form stitches on a fabric using an upper thread T1 and a lower thread T2 that are supplied from the sewing needle and the bobbin, respectively. A thread take-up lever (not shown) serves to take up the upper thread T1 in response to the operation of the hook 14 and the sewing needle. The sewing mechanism including such a sewing needle, a hook and a thread take-up lever is known in this technical field, and therefore will not be described in detail.

The thread cutting device preferably includes a fixed knife 20 and a movable knife 30. The fixed knife 20 may be fixedly mounted on a knife base 18 by means of bolts 21 (see FIG. 1). The knife base 18 also may be fixedly mounted on the hook base 10. A movable knife 30 may be fixedly mounted on an upper end of a knife shaft 40. As shown in FIG. 2, the knife shaft 40 is rotatably supported by the hook base 10 and extends vertically downwardly from the movable knife 30 to a position below the hook base 10. An actuation lever 52 may be connected to the lower end of the knife shaft 40.

An L-shaped bracket 44 may be fixed to the right side (as viewed in FIG. 2) of the hook base 10. A motor 42 may be mounted vertically on the bracket 44 and serves as a drive source of the movable knife 30. The motor 42 has an output shaft 46 extending downward from the motor 42 through the horizontal part of the bracket 44. A drive lever 48 may be secured to the output shaft 46 and may be connected to the actuation lever 52 by means of a connection bar 50. As a result, the rotation of the motor 42 is converted into a reciprocal rotational movement of the knife shaft 40 via the drive lever 48, the connection bar 50 and the actuation lever 52. Therefore, the movable knife 30 reciprocally pivots with the knife shaft 40 around the axis of the knife shaft 40.

Figure 3A:
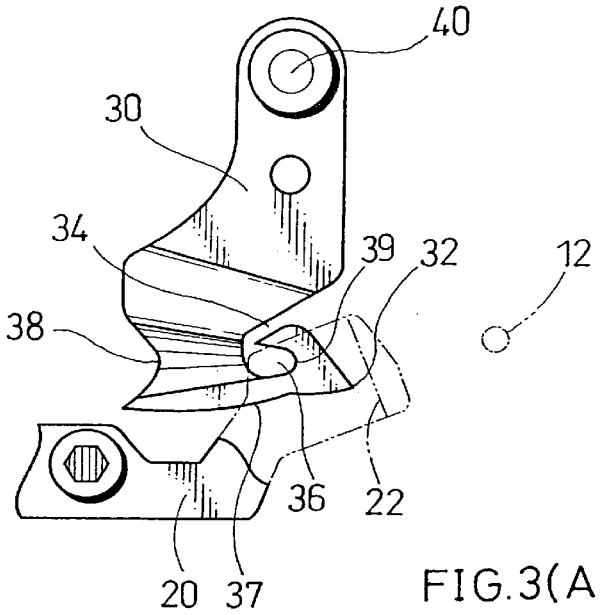
FIGS. 3(A) to 3(E) are explanatory enlarged plan views of a fixed knife and a movable knife of the thread cutting device.

A preferred arrangement for the fixed knife 20 and the movable knife 30 is shown in FIG. 3(A), in which the fixed knife 20 has a front end that includes a cutting edge 22 formed on the lower side thereof. The movable knife 30 has a front end that has an upper thread engaging recess 36 and a lower thread engaging recess 38. The upper thread engaging recess 36 and the lower thread engaging recess 38 are formed on opposite sides of the front end in the pivotal direction of the movable knife 30. The upper thread engaging recess 36 is open to the outside via a slit 34. A cutting edge 39 may be formed on one side of the upper thread engaging recess 36 in the counterclockwise direction as viewed in FIG. 3(A). The cutting edge 39 cooperates with the cutting edge 22 of the fixed knife 20 to cut a thread(s) as will be further explained below. The lower thread engaging recess 38 has a substantially V-shaped configuration in plan view. A pointed end 32 may be formed on the front end of the movable knife on the side of the upper thread engaging recess 36. The pointed end is directed toward the counterclockwise direction as viewed in FIG. 3(A). A guide edge 37 may be formed to connect the pointed end 32 and the lower thread engaging recess 38.

A controller (not shown) outputs control signals to the motor 42 to control the motion of the movable knife 30.

A preferred operation of the above representative embodiment of the thread cutting device will now be explained.

Figure 3B:
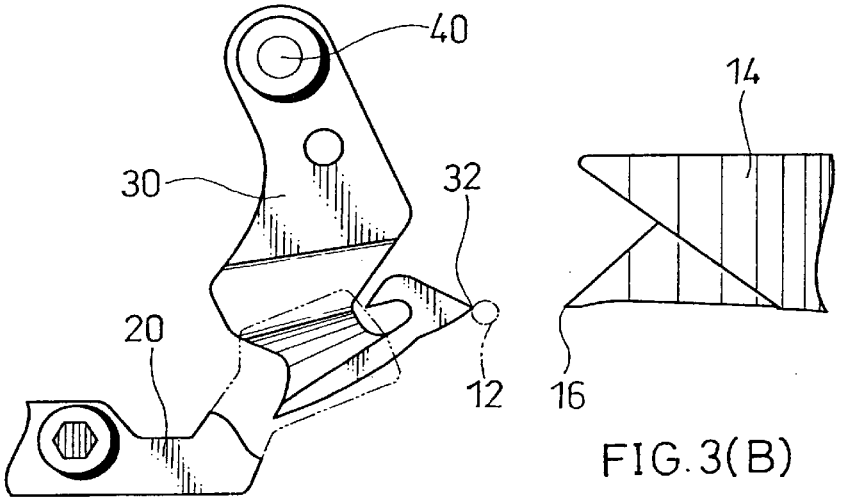

FIGS. 3(A) to 3(E) show a preferred operation for cutting the upper thread T1. In order to cut the upper thread T1 during the sewing operation, the controller outputs a control signal to the motor 42 so as to start the same. The sewing operation is performed through cooperation of the hook 14 or the rotating hook 14*a* with the reciprocating sewing needle in a known manner. As the motor 42 rotates, the movable knife 30 pivots from a waiting position shown in FIG. 3(A) to a first operative position shown in FIG. 3(B). The timing of such movement of the movable knife 30 is chosen such that the pointed end 32 of the movable knife 30 reaches a position adjacent to the needle hole 12, as shown in FIG. 3(B), prior to the engagement of the upper thread T1 by the hook end 16 of the rotating hook 14*a*. For the purpose of illustration, the lower thread T2 is not shown in FIGS. 3(A) to 3(E).

Figure 3C:
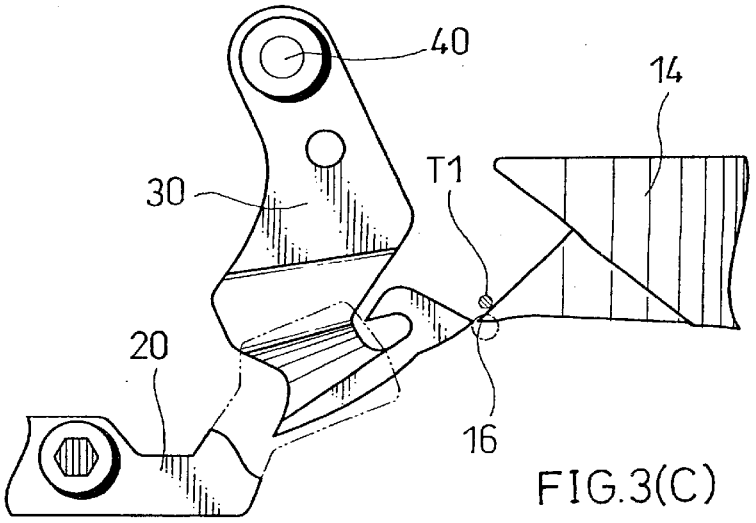

With the movable knife 30 held in the operative position, the hook 14 rotates to engage the upper thread T1 as shown in FIG. 3(C).

Figure 3D:
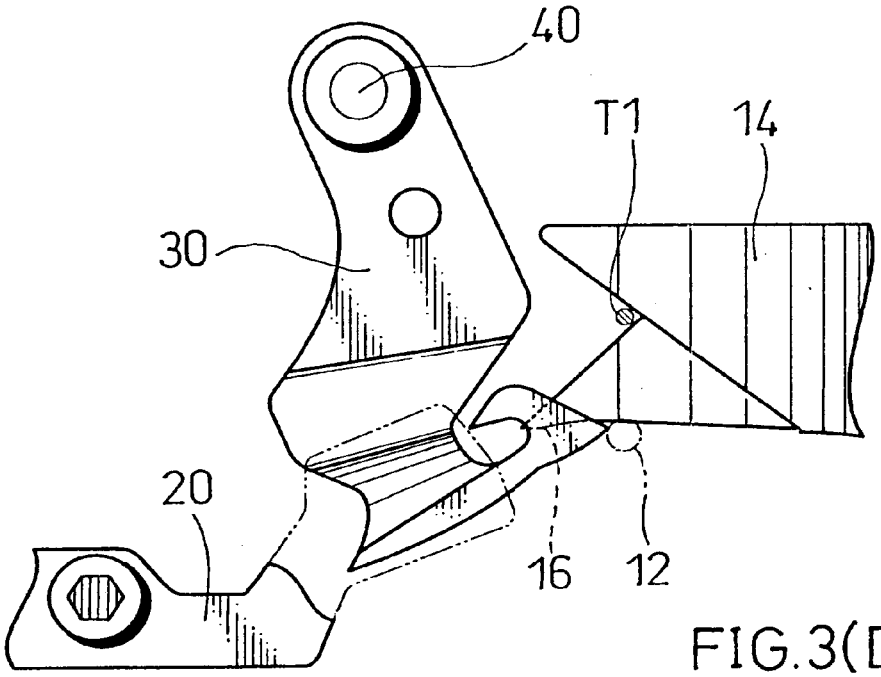
Figure 3E:
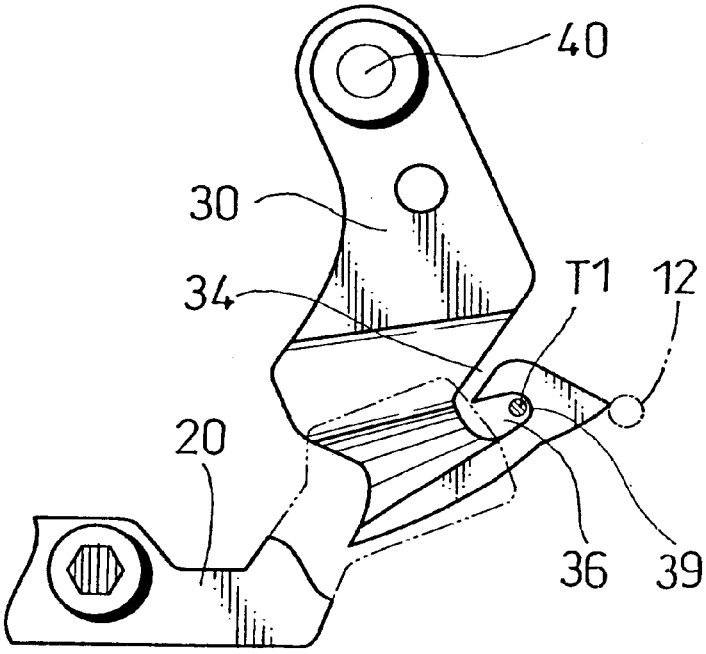

As the hook 14 further rotates, the upper thread T1 is moved inwardly of the hook 14 along an oblique edge of the hook end 16 as shown in FIG. 3(D) and is forced to enter the upper thread engaging recess 36 through the slit 34 as shown in FIG. 3(E).

The controller then outputs a signal to the motor 42 to return the movable knife 30 from the first operative position to the waiting position at substantially the same timing that the thread take-up lever pulls up the upper thread T1. During the returning movement, the upper thread engaging recess 36 of the movable knife 30 moves over the cutting edge 22 of the fixed knife 20, so that the cutting edge 39 of the movable knife 30 cooperates with the cutting edge 22 of the fixed knife to cut the upper thread T1.

Figure 4A:
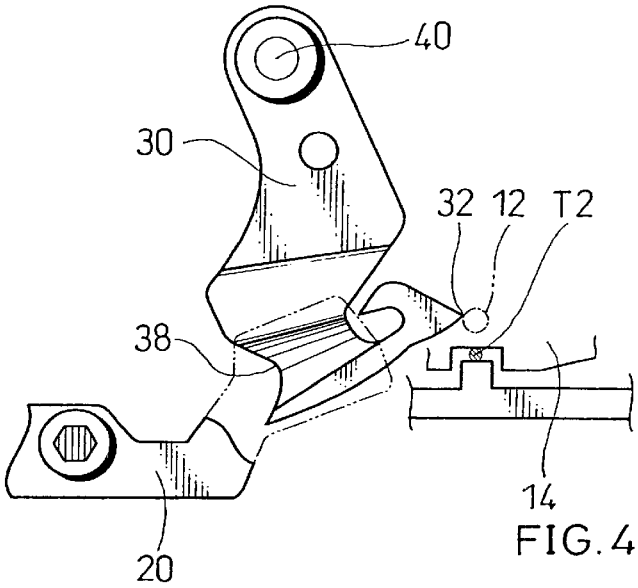
FIGS. 4(A) to 4(E) are explanatory enlarged views showing the operation for cutting a lower thread.

FIGS. 4(A) to 4(E) show a preferred operation for cutting the lower thread T2. In order to cut the lower thread T2, the controller outputs a control signal to the motor 42 to pivot the movable knife 30 from the waiting position to a second operative position via the first operative position. FIG. 4(A) shows the movable knife 30 in the first operative position that is a transient position in the upper thread cutting operation. Thus, the movable knife 30 pivots further from the first operative position.

Figure 4B:
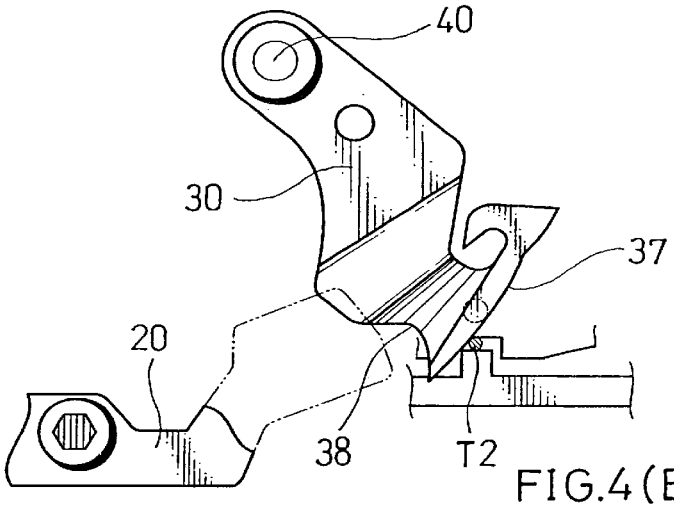
Figure 4C:
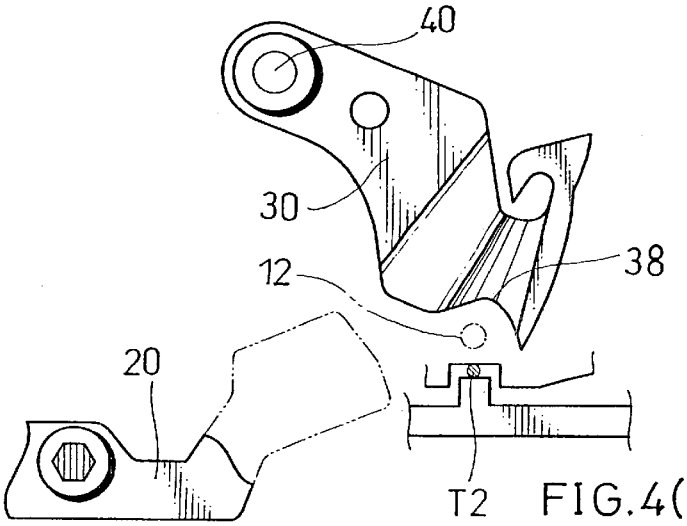

As the movable knife 30 moves further from the first operative position, the guide edge 37 engages the lower thread T2 so as to push the lower thread T2 out of a moving path of the guide edge 37 against the tensioning force applied to the lower thread T2 as shown in FIG. 4(B). When the movable knife 30 reaches the second operative position as shown in FIG. 4(C), the lower thread T2 is disengaged from the movable knife 30, so that the lower thread T2 recovers its position.

Figure 4D:
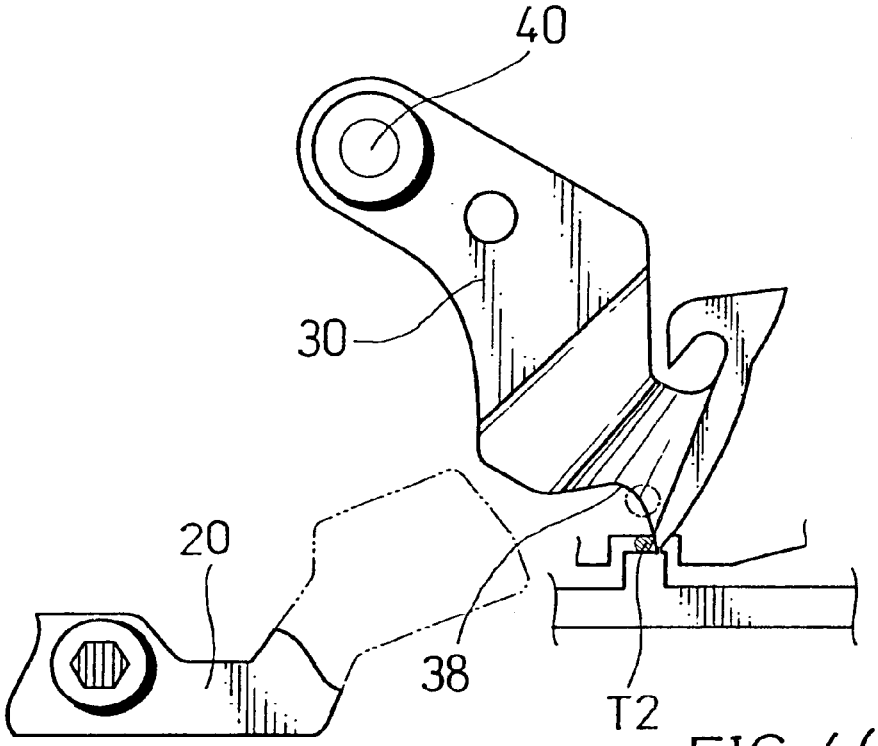
Figure 4E:
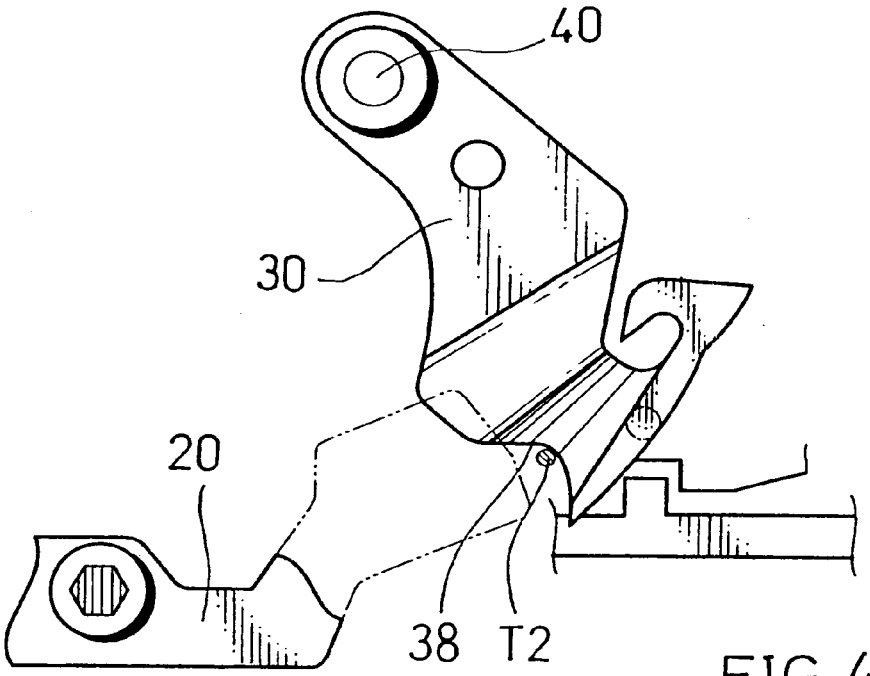

Then, the controller outputs a signal to the motor 42 to return the movable knife 30 from the second operative position to the waiting position. As a result, the lower thread T2 is engaged by the lower thread engaging recess 38 as shown in FIGS. 4(D) and 4(E) and is then cut through cooperation of the cutting edge 39 and the cutting edge 22 of the fixed knife 20.

Figure 5:
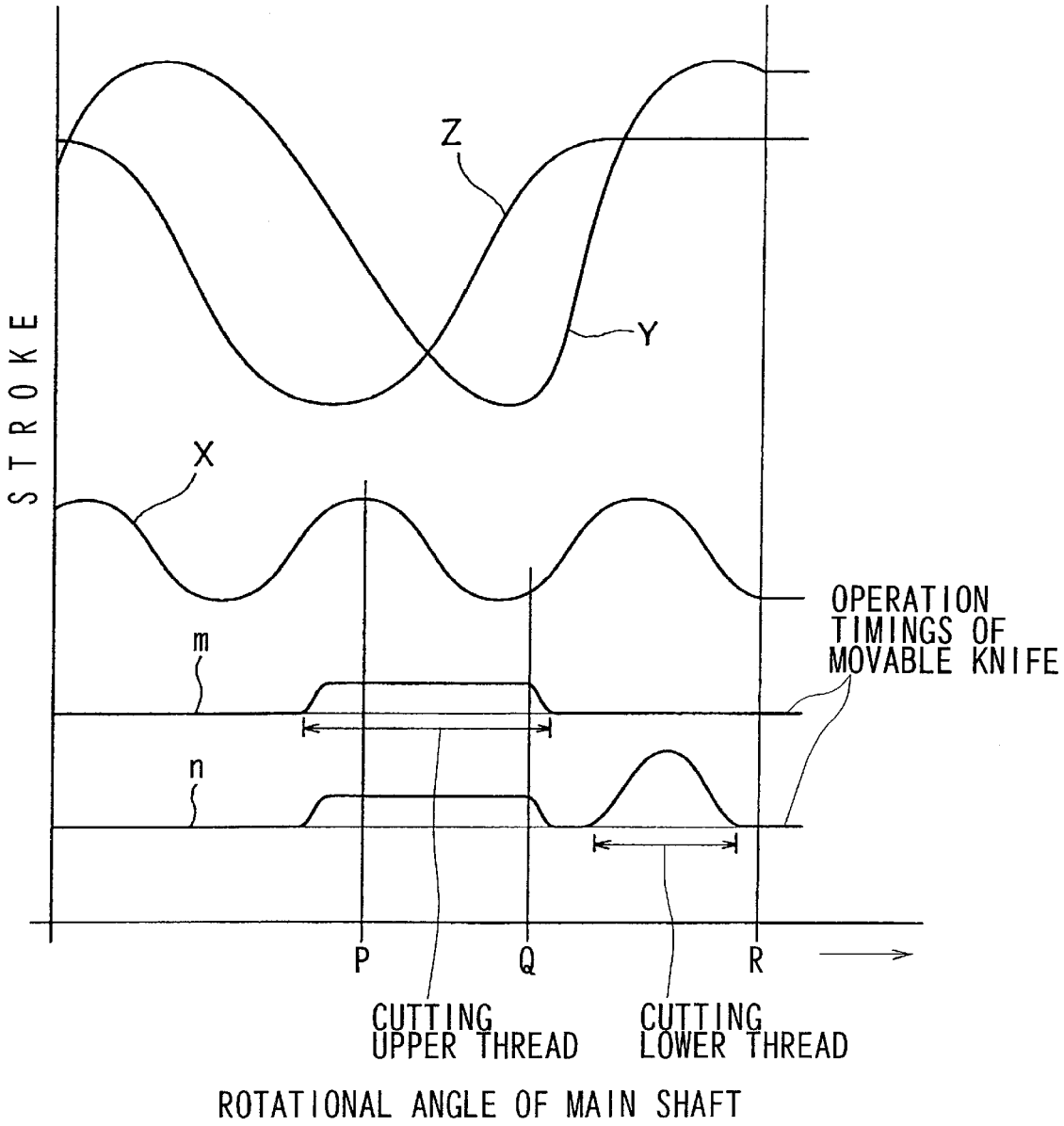
FIG. 5 is a timing chart showing the operation timings of a movable knife in relation to the operation timings of a hook, a thread take-up lever and a sewing needle.

FIG. 5 shows the operation timings of the movable knife 30 in relation to the operation timings of the hook end 16 of the hook 14, the thread take-up lever and the sewing needle. As for the movable knife 30, the thread take-up lever and the sewing needle, the ordinate of FIG. 5 represents stroke positions of these elements. As for the hook end 16, the ordinate of FIG. 5 represents the vertical position of the hook end 16 relative to a reference position. The abscissa of FIG. 5 represents the rotational angle of the main shaft of the sewing machine, which main shaft drives the hook 14, the thread take-up lever and the sewing needle in synchronism with each other.

Lines X, Y and Z depict the operation timings of the hook end 16, the thread take-up lever and the sewing needle, respectively. Line m depicts a motion line of the movable knife 30 when only the upper thread T1 is to be cut. Line n depicts a motion line when both the upper thread T1 and the lower thread T2 are to be cut.

Timing P is a timing when the upper thread TI is engaged by the hook end 16. As previously described, the movable knife 30 starts to move from the waiting position to the first operative position prior to timing P. The movable knife 30 starts to return from the first operative position to the waiting position at substantially timing Q. Timing Q represents the timing when the thread take-up lever starts to pull up the upper thread T1. After the upper thread T1 has been cut, a portion of the cut upper thread continues to extend from the sewing needle. The length of such a remaining cut portion can be varied by changing the returning timing of the movable knife 30. Thus, the length of the remaining cut portion becomes shorter as the delay in time of the returning timing becomes greater.

As shown in FIG. 5, the operation period of the movable knife for cutting the lower thread is different from that for cutting the upper thread. Therefore, both the upper thread T1 and the lower thread T2 can be cut by performing the cutting operation of the lower thread T2 subsequent to the cutting operation of the upper thread T1 as indicated by line n. Timing R is a timing when the sewing machine is stopped or when the main shaft is stopped. As for the sewing needle, the sewing needle is disengaged from the main shaft so as to be held in an uppermost position as soon as the movable knife 30 moves to cut the lower thread T2.

Because the movable knife 30 is driven by the motor 42 independently of the main shaft, the lower thread cutting operation can be performed even after the main shaft has stopped.

Although the movable knife 30 is pivotally moved in the above preferred representative embodiment, the movable knife 30 may perform a different movement, such as a linear movement with the aid of an appropriate slide mechanism. In addition, the motor 42 may be replaced with a cam mechanism that is driven by the main shaft of the sewing machine.

Further, although the thread cutting device has been described in the above preferred representative embodiment in connection with the cutting operation for cutting only the upper thread T1 or for cutting both the upper thread T1 and the lower thread T2, the thread cutting device may be operated to cut only the lower thread T2. For example, it may be preferable that only the lower thread T2 is cut if the lower thread T2 is to be changed to another lower thread having a different color.

What is claimed is:

1. A thread cutting device in a sewing machine for forming stitches on a fabric using an upper thread and a lower thread, comprising:

a fixed knife and a movable knife cooperating with each other to cut either one or both of the upper and lower threads, said movable knife being operable to cut the upper thread at a first timing and to cut the lower thread at a second timing that is different from said first timing.

2. The thread cutting device as defined in claim 1 wherein said second timing is determined to be subsequent to said first timing.

3. The thread cutting device as defined in claim 1 wherein said movable knife includes a cutting edge, an upper thread engaging portion, and a lower thread engaging portion, said upper thread engaging portion and said lower thread engaging portion being disposed at different positions from each other.

4. A thread cutting device in a sewing machine for forming stitches on a fabric using an upper thread and a lower thread, comprising:

a fixed knife and a movable knife cooperating with each other to cut either one or both of the upper and lower threads, said movable knife being operable to cut the upper thread at a first timing and to cut the lower thread at a second timing that is different from said first timing wherein said movable knife is operable to move within a first movable range and a second movable range for engaging and cutting the upper thread and the lower thread, respectively, said first movable range and said second movable range being different from each other.

5. The thread cutting device as defined in claim 4 wherein said first movable range extends between a waiting position and a first operative position, and wherein said second movable range extends between said waiting position and a second operative position.

6. The thread cutting device as defined in claim 5 wherein said movable knife includes a cutting edge, an upper thread engaging portion and a lower thread engaging portion, and wherein said movable knife in said first operative position permits the upper thread to be engaged with said upper thread engaging portion as a hook of the sewing machine rotates with the upper thread engaged by said hook.

7. An apparatus for cutting a first thread and a second thread, comprising:

a first knife;

a second knife that moves relative to said first knife; and, a controller;

said second knife moving in response to commands from said controller, said controller generating at least a first command to cut the first thread and a second command to cut the second thread wherein said first command is generated before said second command.

8. An apparatus for cutting a first thread and a second thread, comprising:

a first knife;

a second knife that moves relative to said first knife; and, a controller;

said second knife moving in response to commands from said controller, said controller generating at least a first command to cut the first thread and a second command to cut the second thread;

wherein said first command is generated before said second command and wherein said second knife has a first range of motion to cut the first thread and a second range of motion to cut the second thread.

9. The apparatus as defined in claim 8 wherein said first range of motion extends from a first position to a second position, and said second range of motion extends from said first position to a third position.

10. The apparatus as defined in claim 9 wherein said second knife has a cutting edge, a first thread engaging portion and a second thread engaging portion, and wherein said first thread engaging portion engages the first thread in said second position and said second thread engaging portion engages the second thread in said third position.

11. A sewing machine comprising the apparatus of claim 10 and a motor for driving said second knife.

* * * * *